United States Patent [19]

Dyer et al.

[11] 4,375,339

[45] Mar. 1, 1983

[54] ELECTRICALLY CONDUCTIVE RIBBON BREAK DETECTOR FOR PRINTERS

[75] Inventors: Stanley Dyer; James J. Molloy; Donald A. Walker, all of Lexington, Ky.

[73] Assignee: International Business Machines Corporation, Armonk, N.Y.

[21] Appl. No.: 211,886

[22] Filed: Dec. 1, 1980

[51] Int. Cl.[3] ..... B41J 35/36

[52] U.S. Cl. ..... 400/249; 400/120; 400/229; 400/241

[58] Field of Search ..... 400/119, 120, 194, 195, 400/196, 196.1, 207, 208, 208.1, 229, 241, 241.1, 241.2, 249

[56] References Cited

U.S. PATENT DOCUMENTS

| | | | |
|---|---|---|---|
| 2,419,369 | 4/1947 | Ritzert | 400/249 X |
| 3,577,137 | 5/1971 | Brennan, Jr. | 219/216 X |
| 4,146,338 | 3/1979 | Hedstrom | 400/249 |
| 4,212,552 | 7/1980 | Bemis et al. | 400/249 |

OTHER PUBLICATIONS

IBM Technical Disclosure Bulletin, "Thermal Transfer Printer Employing Special Ribbons Heated with a Current Pulse", Mitchell et al., vol. 18 No. 8 Jan. 1976, p. 2695.

IBM Technical Disclosure Bulletin, "Ribbon Condition Sensor," Standiford, Jr., vol. 20 No. 6 Nov. 1977, pp. 2305-2307.

*Primary Examiner*—Ernest T. Wright, Jr.

*Attorney, Agent, or Firm*—John W. Girvin, Jr.; George E. Grosser

[57] ABSTRACT

A ribbon feed failure in a printer can cause serious problems, particularly for a printer that uses heat to cause selective ink transfers. Localized heat buildup may injure the printhead and, if allowed to continue, might injure other printer instrumentalities.

According to the invention, it is recognized that for ribbons having a degree of electrical conductivity, a mechanical ribbon failure will almost always result in a detectable change of electrical properties. By monitoring the characteristics of an electrical circuit passing through a section of the ribbon around the print point and, preferably, also the printhead-ribbon interface, abnormal electrical parameter values that indicate ribbon failure may be detected to trigger a cessation of printer operation.

For a presently preferred implementation in a printer that uses a printhead with multiple electrodes for supplying current to a ribbon, the electrode voltage levels for a plurality of non-adjacent electrodes are combined to provide a resultant voltage level that is examined to detect abnormalities. By so combining voltages, insignificant excursions in electrical characteristics as might result from minor ribbon imperfections are generally eliminated from the triggering of a shutdown response, while still retaining a rapid response for preventing further heat generation in those situations where a serious ribbon failure has occurred.

14 Claims, 6 Drawing Figures

FONT GEN.
66
PRINTER CONTROL
64
CLK
G
G1
GN
ELECTRODE DRIVERS
62
D1
DN
D
60
82
LA
LATCH
81
RESET
THRESHOLD DETECTOR
72
SA
SR
70
71
84
VS=24V
56
22'
24'
57
58
50
52
54
TO TAKEUP

SA
80
78
TS
G
76
72
73
LEVEL DETECTOR SR>20
LEVEL DETECTOR SR<2
74
SR

DARKNESS CONTROL
104
FONT GEN
66
PRINTER CONTROL
64
CLK
G
G1
GN
Sc
Vs
84
82
LA
RESET
119
118
117
114
VR
116
112
110
115
300
302
304
SDA
SDB
SDC
100
D1
Dn
60
22'
56
24'
57
58
62'
102

Vs
VH
VL
SDx
Dx

ELECTRICALLY CONDUCTIVE RIBBON BREAK DETECTOR FOR PRINTERS

BACKGROUND OF THE INVENTION

1. Technical Area of the Invention

The present invention relates, in general, to printers that employ an inked ribbon and, in particular, to ribbon break detectors for such printers.

2. Art Statement

For printers that use an inked ribbon, one possible source of malfunction is a ribbon feed failure such as a break in the ribbon. A basic technique for detecting ribbon breaks is to monitor the tension in the ribbon. Also, a break may be detected optically by a sensor located along the ribbon path. Such break detection, however, tends to be unreliable, particularly for thermal printing where heat buildup may occur at the printhead and cause sudden damage to the printhead and surrounding apparatus.

SUMMARY OF THE INVENTION

With the present invention, it is recognized that, for ribbons having some degree of electrical conductivity, a significant mechanical ribbon failure is generally accompanied by a detectable change in electrical integrity. According to the invention, an electrical characteristic of the ribbon in the vicinity of the current print zone is monitored on a regular basis to detect electrical changes that indicate abnormal operation. To detect significant electrical change in a printer that supplies electrical printing currents to the ribbon, it is preferred to use the printhead as a part of the electrical path for the detection circuit. By so including the printhead, the junction between the printhead and the ribbon, where a ribbon burnthrough is likely to occur, is permitted to have a direct influence on the detection.

In a presently preferred implementation of the invention, for a printing system that supplies printing currents to a ribbon through a set of printhead electrodes, the voltage levels at a plurality of non-adjacent printing electrodes are monitored and a signal that is developed from a combination of the monitored electrode voltage levels is compared to a reference voltage level to identify abnormal operation. By so selecting a plurality of electrodes and using a composite of electrode voltage signals, insignificant abnormalities in electrical characteristics, such as those resulting from ribbon imperfections, are excluded from the detection in order to avoid unnecessary printer shutdowns.

According to an alternative detection arrangement, voltages applied to the ribbon at the print point are monitored at a ribbon location on the side of the print point opposite a current return contact. With a break in the ribbon path between the monitoring point and the current zone of printing, essentially zero voltage is detected. If, however, a break occurs between the print point and the return contact, the monitored voltage will rise to the no load level for the printhead driver. Voltages in either of these two ranges then serve to indicate improper operation.

As a further alternative for the invention, an electrical signal independent of the printing process may be applied to the conducting ribbon in order to provide an electrical parameter that may be monitored for failure detection purposes and would change upon the occurrence of a ribbon failure. For example, the impedance of an electrical path between ribbon contact locations on opposite sides of the print point may be monitored using a low level detection current. A ribbon break would result in a detectable cessation of current flow.

PREFERRED IMPLEMENTATIONS OF THE INVENTION

The invention will now be described in detail with reference to the drawing wherein.

Figure 1:
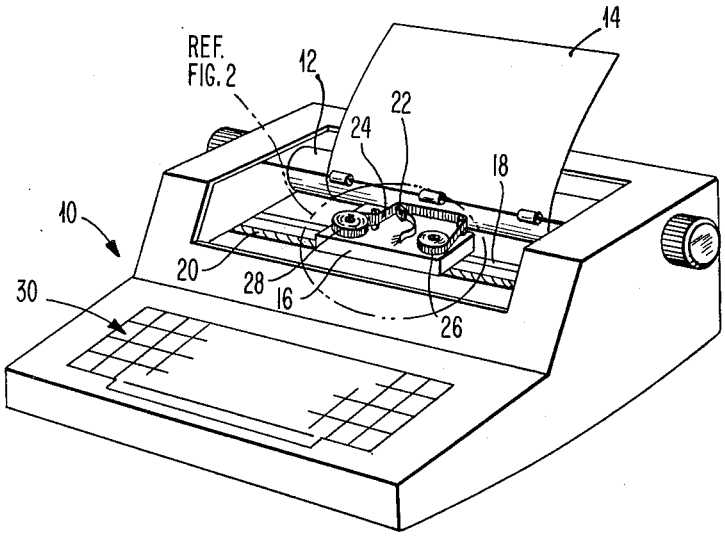
FIG. 1 is a simplified perspective view of a printer environment suitable for implementation of the invention.
Figure 2:
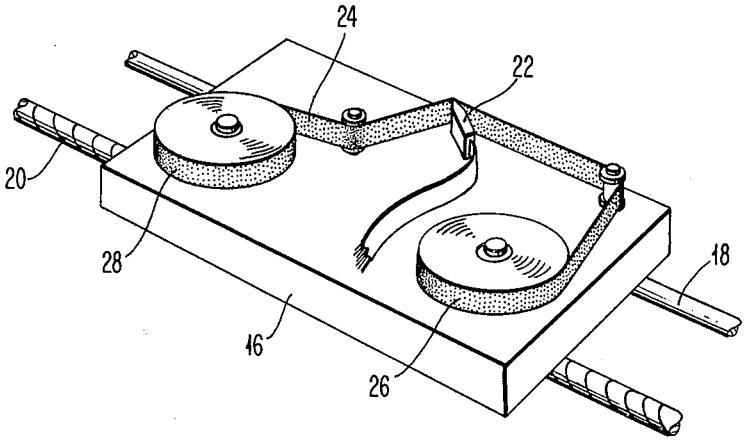
FIG. 2 is a simplified perspective view emphasizing the ribbon path of FIG. 1.

Referring to FIGS. 1 and 2 a suitable printer 10 to serve as an environment for the present invention includes a platen 12 with cooperating rollers (not shown) to define a feed path for a receiving medium 14. A carrier 16 is mounted to permit relative movement respective of platen 12 to define a printing axis. Drive means such as a leadscrew 20 and cooperating driver (not shown) controllably cause relative motion between the carrier 16 and the platen 12 to establish a print line for a printhead 22 mounted on the carrier 16. An electrically conducting printing ribbon 24 is arranged to pass along a path extending between the printhead 22 and the platen 12. While motion of the carrier 16 along an axis defined by a rail 18 to be parallel to an axis of platen 12 is indicated, the desired relative motion may, as is well known, also be achieved by moving the platen 12.

During printing, the printing ribbon 24 is advanced from a ribbon supply 26 to a ribbon takeup 28 by ribbon feed means (not shown), as is well known in the art. The ribbon supply 26 and the ribbon takeup 28 may be arranged on the carrier 16 or on the printer frame (not shown). For an interactive printer 10, a keyboard 30 would be provided and to facilitate a high level of print line visibility, it is generally preferable to mount the ribbon supply 26 and the ribbon takeup 28 on the carrier 16. During printing operation, the printhead 22 urges the ribbon 24 against the receiving medium 14 and establishes a print zone where marking to form patterns or characters occurs.

Figure 3:
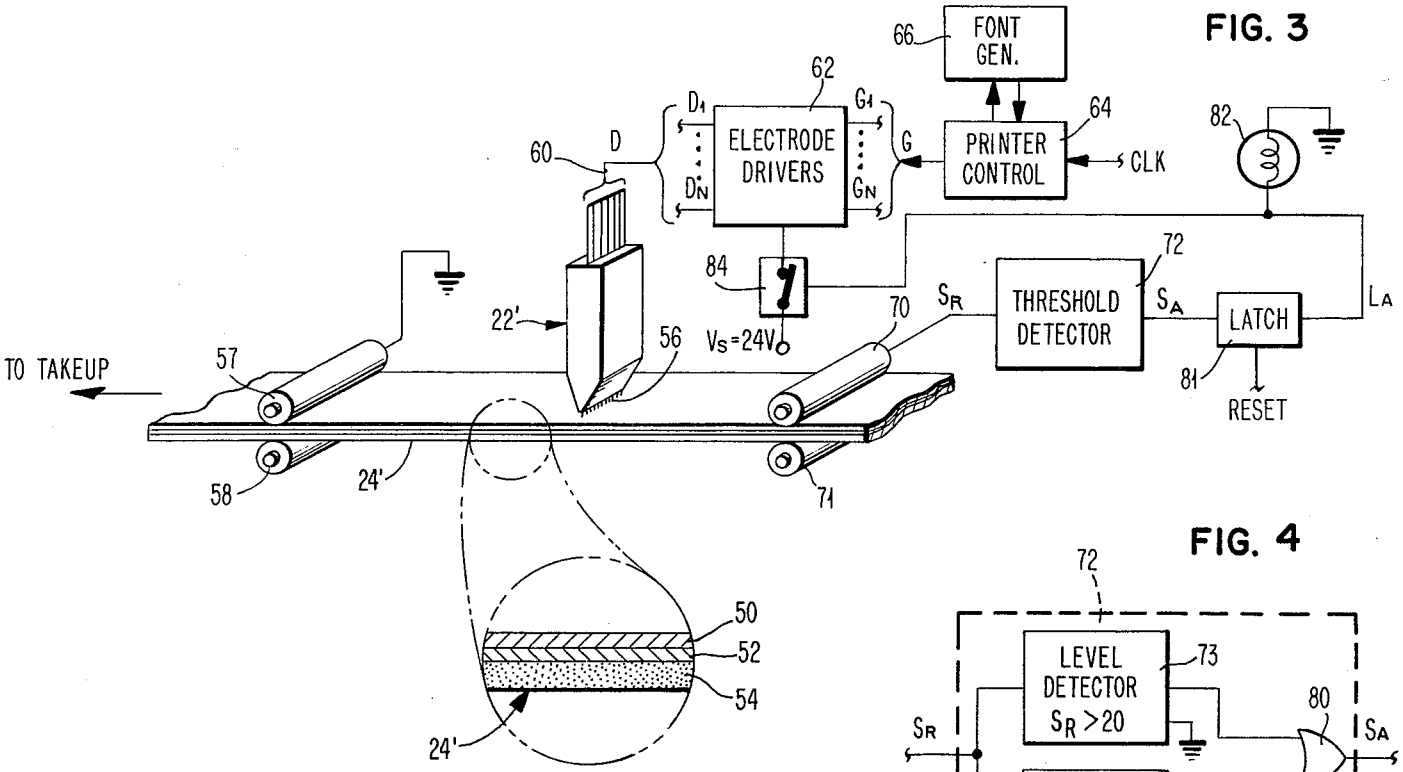
FIG. 3 is a diagram, mainly in block form, indicating a detection arrangement according to the invention.
Figure 4:
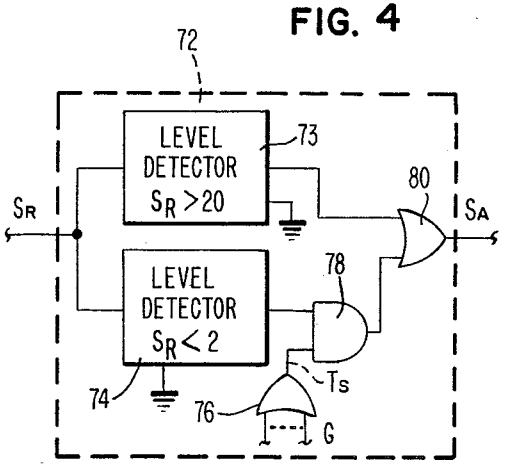
FIG. 4 is a diagram of a level detection circuit for use as the threshold detector of FIG. 3.

Referring to FIG. 3, a break detector arrangement is implemented with an electrically conducting printing ribbon 24' (primes are added to emphasize references to a more particular structure) that includes a moderately resistive layer 50, a conducting layer 52 and an ink layer 54. Printing currents are supplied to the ribbon 24' by the printhead 22' which includes an array of printing electrodes 56. During printing, electrical currents are injected into the ribbon 24' by the printhead 22' to cause localized heating which causes, in turn, printing transfers of portions of the ink layer 54. A current return path is provided by a ground contact 57 that is maintained in engagement with moderately resistive layer 50 by a cooperating roller 58. Current is supplied to the respective electrodes 56 by plural conducting channels 60 that are connected to supply current signals D from a set of electrode drivers 62.

A suitable type of electrode driver circuitry is discussed in more detail below. Control signals G for the respective electrode drivers 62 are generated in timed relation to a clock signal CLK by a printer control 64 that cooperates with a font generator 66. Such printer control 64 to provide timed control signals G for printing is well known for matrix printers. Typically, the font generator 66 is a storage including digital representations of the patterns for the various graphics producible by the printer 10.

According to the invention, an electrical parameter is monitored to detect abnormal operation indicative of a ribbon failure. For the implementation of FIG. 3, it is the voltage at the surface of the printing ribbon 24' that is monitored and advantage is taken of the influence of the printhead 22' on the monitored voltage as printing operations are being performed. (The ribbon path is indicated as being straight for convenience of illustration but would typically wrap around the printhead 22'.)

To monitor ribbon voltage, a contact 70 cooperates with a pressure roller 71 to engage the surface of the moderately resistive layer 50 of the printing ribbon 24'. The contact 70 is located to the side of the printhead 22' away from the ground contact 57. This contact arrangement establishes a detection circuit that includes the printhead-ribbon interface and the section of the ribbon 24' extending between the print point and the location of the contact 70. The ribbon voltage signal $S_R$ is supplied to threshold detector 72 which detects abnormal voltage levels. Such a threshold detector 72 may include individual comparators 73 and 74 with fixed reference voltage inputs that correspond to predetermined thresholds for abnormal operation. An abnormally high level, in view of the supply voltage Vs, would be empirically determined and might, for example, include all levels above 20 volts assuming the voltage level of source Vs is 24 volts. An abnormally low voltage level would also be determined empirically and might, for example, include all levels below 2 volts.

A problem with the low level detection occurs, however, because the occurrence of a low level is abnormal only when electrode drive signals D are being applied. To limit the sampling period for such low level occurrences correspondingly, the signals G are processed at an OR gate 76 to produce a signal Ts to identify valid sampling times. An AND gate 78 allows the signal from the level detector 74 to pass only when the signal Ts identifies a valid sampling interval. All valid detections pass through an OR gate 80 and then as signal $S_A$ to a resettable latch 31 which produces an alarm signal $L_A$ indicative of abnormal operation. Responsive to the alarm signal $L_A$ an indicator 82, such as an indicator lamp, is activated and a signal controlled switching device 84 deactivates the electrode drivers 62 to prevent any further supply of energy to the printhead 22'. Such deactivation may be effected by blocking the supply voltage Vs (as shown) or by blocking the control signals G that trigger the electrode drivers 62.

Figure 5:
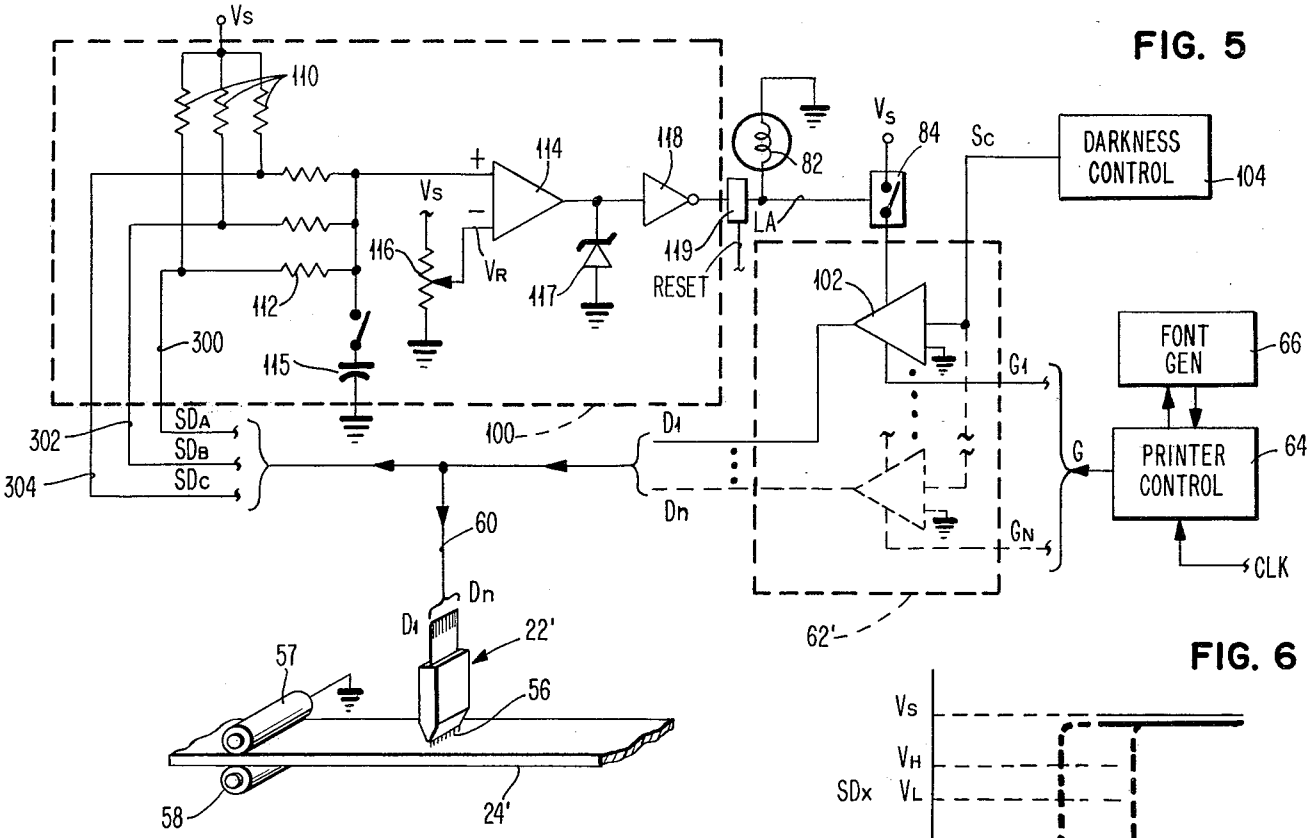
FIG. 5 is a diagram indicating a circuit arrangement for practicing the invention according to a presently preferred implementation.

A presently preferred approach to detecting ribbon defects monitors plural electrode voltages concurrently to minimize unnecessary printer shutdowns when insignificant signal perturbations occur. Referring to FIG. 5, a detector 100 is connected to the channels 60 that transmit the signal D to the printhead 22'. This connection establishes a detection circuit that includes the printhead-ribbon interface and the section of the ribbon 24' extending from the print point at the printhead 22' to the ground contact 57. For a presently preferred implementation, the printhead 22' includes forty individual electrodes 56 and signals (denoted $SD_A$, $SD_B$, and $SD_C$) for three non-adjacent ones of the electrodes 56 are supplied to the detector 100 over channels 300, 302 and 304. For the presently preferred implementation, the signals $SD_A$, $SD_B$ and $SD_C$ for the tenth, twentieth and thirtieth electrodes 56 of a row of forty are selected. Before describing the detector 100 in detail, the electrode drivers 62' should be considered.

Figure 6:
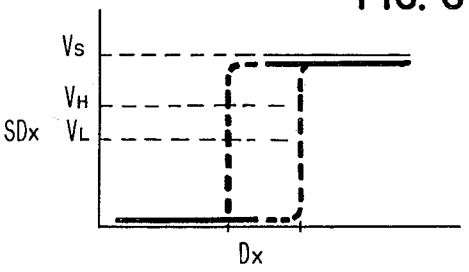
FIG. 6 is a diagrammatic representation of a voltage waveform for an electrode driver.

The electrode driver 62' for the presently preferred system includes respective electrode current sources 102 that are energized from the supply Vs, preferably at 24 volts. The level of current supplied, Se, is adjustable by a voltage supplied from a darkness control 104, which may be a manually adjustable potentiometer connected to a voltage source, such as the source Vs. For an operating range of electrode currents (see FIG. 6), a normal electrode voltage range ($V_L$ to $V_H$) is identifiable which corresponds to normal printer operation. Voltage controlled current drivers suitable for use as the current sources 102 are known and as is indicated in FIG. 6 which plots drive current Dx versus the voltage SDx of a given electrode 56, the current source 102 would saturate slightly below the supply voltage Vs.

Now, considering the detector 100, the signals on channels 300, 302 and 304 are supplied at the junction points for two parallel sets (denoted 110 and 112) of resistors having high resistance values (47 K ohms for the presently preferred implementation). The resistors 110 are connected to the source voltage Vs and the resistors 112 are connected to the positive input terminal of a differential amplifier 114. A summing of the voltages on the channels 300, 302 and 304 is effected by the connection of the resistors 112 to the differential amplifier 114.

The connections to source voltage $V_S$ through resistor set 110 are effective to provide for a detection in the event of a loss of continuity with the ribbon 24' occurring when one or more of the monitored electrodes 56 are not selected to transmit printing current. For such a loss of contact condition, the voltage of an affected electrode 56 will rise to the supply voltage $V_S$ because there is insufficient current flow through the respective resistor of resistor set 110 to cause a significant voltage drop. As connected, the resistors 110 effectively serve in providing a high impedance voltage source that supplies a detectable signal for open circuit conditions. Insufficient current flows through the resistors 110 during normal ribbon contact to influence printing operations.

A reference signal is supplied to the negative terminal of the differential amplifier 114 by a potentiometer 116 connected to the source voltage Vs. By using a composite of electrode voltages for comparisons, the reference voltage $V_R$ can be chosen to correspond to loss of circuit continuity for any number of the monitored electrodes 56. Preferably, three non-adjacent electrodes 56 are monitored and the reference level voltage $V_R$ is chosen sufficiently close to the source voltage to require a loss of circuit continuity for all three monitored electrodes 56. By so requiring that multiple non-adjacent electrodes 56 lose circuit continuity, a detection is unlikely to occur for temporary perturbations, such as those resulting from minor surface defects in the ribbon 24', while a rapid response is nonetheless achieved if a ribbon 24' break or burnthrough occurs. A capacitor 115 may be added at the input to the differential amplifier 114 to filter out momentary voltage spikes and/or introduce slight delay. For a particular printing system, a suitable size for the capacitor 115 would be determined by experimentation.

The signal from the differential amplifier 114 is limited to four volts by a Zener diode 117 and is then inverted by an invertor gate 118. The output of the invertor gate 118 is supplied to a resettable latch 119 that produces an alarm signal $L_A$. When a detection occurs, alarm signal $L_A$ activates the indicator 82 and the signal controlled switching device 84, as was discussed above. In this way, further supply of energy to the printhead 22' is blocked and heat buildup is consequently avoided. The signal $L_A$ may be used to additionally block other printer operations such as carrier movements.

It should be appreciated that if a voltage signal was supplied to the electrodes 56 rather than a current signal, the signals $SD_A$, $SD_B$ and $SD_C$ could be derived by monitoring current (e.g. using current transformers). Abnormal current levels would then be detected to produce the alarm signal $L_A$.

The invention has been described in detail with reference to preferred implementations thereof. However, it will be appreciated that variations and modifications are possible within the spirit and scope of the invention. For example, in a printer that employs a ribbon, but does not apply electrical signals to the ribbon for the purpose of causing ink transfers, electrical signals may be applied by the detection apparatus at one location along the ribbon path and monitored at a second location selected so that the print point or zone is included in the section of ribbon through which the monitored signal travels. Also, the invention may be employed with ribbon printers that use type elements rather than a printing matrix where such printers are supplied with an electrically conducting ribbon.

We claim:

1. For use in a printer of the kind that includes a printhead with an associated printhead driver and utilizes an ink ribbon which is electrically conductive and advances relative to said printhead to establish a print zone at which current printing operations occur, a ribbon monitoring system comprising:

a signal means for applying an electrical signal to said ribbon, said signal means defining a detection circuit which is completed through a ribbon section including said print zone;

means for monitoring an electrical parameter of said detection circuit and for producing a signal in response to excursions of said parameter outside of a preselected range for normal operation; and means responsive to said signal for disabling said printhead driver.

2. A ribbon monitoring system according to claim 1 but further including means for modifying said preselected range during particular intervals of printer operation.

3. A ribbon monitoring system according to claim 1 or 2 but further including an operator viewable indicator and means for causing a change in the state of said indicator in response to said signal.

4. For use in a printer of the kind that utilizes an electrically conducting marking ribbon and has a printhead that includes plural electrodes arranged to electrically contact said ribbon and where said printhead cooperates with driver means for selectively supplying printing signals to said electrodes to cause corresponding marks to be formed on a receiving medium, a malfunction detection system comprising:

means for monitoring an electrical parameter related to the printing signals supplied to at least one of said electrodes, said monitoring means including detector means for producing a departure signal in response to a departure from a predefined normal range of parameter values; and means for disabling said driver means from supplying signals to said ribbon in accordance with the presence of said departure signal.

5. A malfunction detection system according to claim 4 wherein said monitoring means monitors electrical parameters related to printing signals for plural non-adjacent electrodes of said printhead.

6. A malfunction detection system according to claim 5 wherein a parameter based on a composite of the signals for said plural monitored electrodes is produced by said monitoring means and said detector means produces said departure signal in response to a departure of the composite signal parameter from a predefined normal range.

7. A malfunction detection system according to claim 6 wherein said composite signal parameter is a sum of voltages for said monitored electrodes.

8. A malfunction detection system according to claim 7 further including high impedance signal means connected to said monitored electrodes for supplying a significant voltage at said monitored electrodes for only a substantially zero current flow condition.

9. A malfunction detection system according to claim 7 wherein said detection circuit includes a differential amplifier that compares a composite of voltages for the monitored electrodes with a fixed reference voltage level.

10. A malfunction detection system according to claim 9 wherein a capacitor is connected to the input of said differential amplifier to disensitize the amplifier input for brief perturbations occurring in electrode voltages.

11. A malfunction detection system for use with a printer of the kind that utilizes an electrically conducting ink ribbon and a printhead with plural electrodes that engage said ink ribbon and supply printing signals thereto;

said malfunction monitoring system comprising:

means for electrically contacting said ribbon at a location removed from said printhead;

means cooperating with said contacting means for comparing the voltage generated by said printing signals at said removed ribbon location to at least one preselected reference voltage level, said cooperating means including means for producing an alarm signal indicating an abnormal relationship to one of said reference voltage levels, and an indicator responsive to said alarm signal to provide an operator perceivable change of state.

12. A malfunction detection system according to claim 11 but further including means for cancelling said printing signals in response to said alarm signal.

13. A malfunction detection system according to claim 11 but further including means for cancelling the comparison for at least one reference voltage level during selected intervals of printer operation.

14. For use in a printer of the kind that includes a printhead with an associated printhead driver and utilizes an ink ribbon which is electrically conductive and advances relative to said printhead to establish a print zone at which current printing operations occur, a ribbon monitoring system comprising:

a signal means for applying an electrical signal to said ribbon, said signal means defining a detection circuit which is completed through a ribbon section including said print zone;

means for monitoring an electrical parameter of said detection circuit and for producing an alarm signal in response to excursions of said parameter outside of a preselected range for normal operation;

an indicator that exhibits a change of state perceivable by an operator; and means for causing a change in the state of said indicator in response to said alarm signal.

* * * * *